US005569061A

United States Patent [19]

Kremen

[11] Patent Number: 5,569,061

[45] Date of Patent: Oct. 29, 1996

[54] METHOD AND DEVICE FOR MAGNETO-ABRASIVE MACHINING OF PARTS

[76] Inventor: Genady Kremen, 150 95 Street, Brooklyn, N.Y. 11209

[21] Appl. No.: 441,721

[22] Filed: Apr. 12, 1995

[51] Int. Cl.[6] ..... B24C 5/08

[52] U.S. Cl. ..... 451/93; 454/37; 454/317; 454/103

[58] Field of Search ..... 457/93, 60, 36–40, 457/104, 106, 113, 114

[56] References Cited

U.S. PATENT DOCUMENTS 4,977,707 12/1990 Chachin et al. ..... 451/37

FOREIGN PATENT DOCUMENTS 403184761 8/1991 Japan ..... 451/93

73728 10/1964 U.S.S.R. ..... 451/317

1541031 2/1988 U.S.S.R. ..... 451/93

1703413 1/1989 U.S.S.R. ..... 451/93

*Primary Examiner*—D. S. Meislin

*Assistant Examiner*—George Nguyen

*Attorney, Agent, or Firm*—Ilya Zborovsry

[57] ABSTRACT

A method of and a device for magnetic-abrasive machining of parts has an external magnetic field providing a magnetic flux, a supply of a magnetic-abrasive powder to the part in the magnetic field. The part is rotated and oscillated about the longitudinal axis so that magnetic-abrasive powder is displaced by the rotating part in a circumferential direction. A fluid jet is directed toward the magnetic-abrasive powder so as to press the magnetic-abrasive powder against a surface of the part. The fluid jet is to improve the material removal rate of machining.

6 Claims, 1 Drawing Sheet

FIG. 1
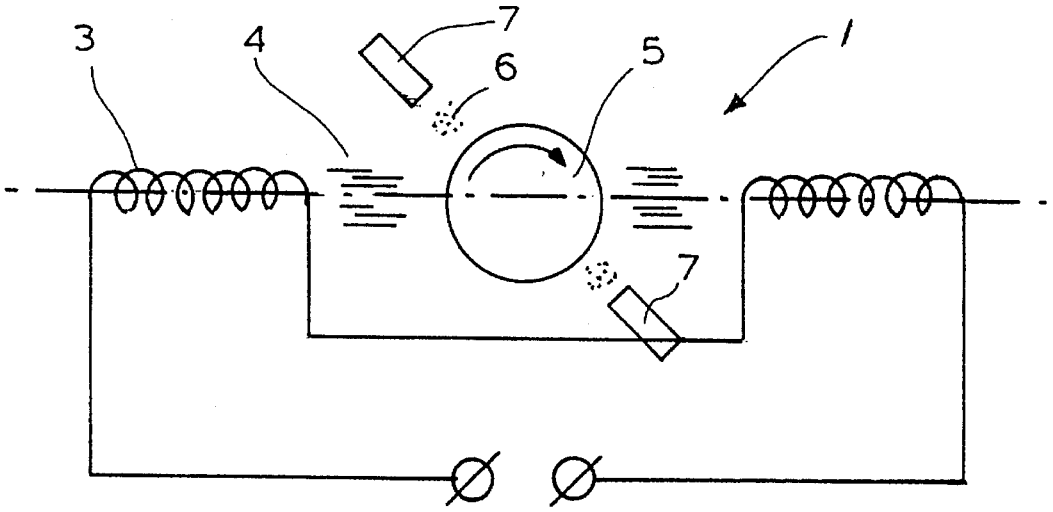
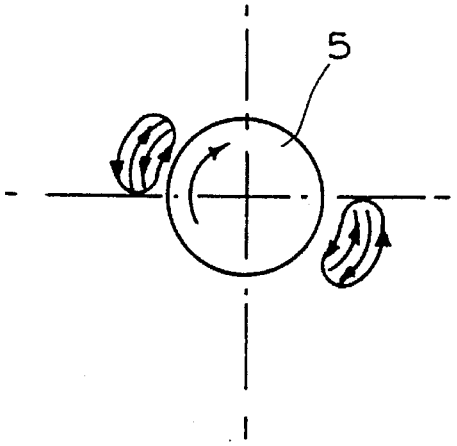
FIG. 2

METHOD AND DEVICE FOR MAGNETO-ABRASIVE MACHINING OF PARTS

BACKGROUND OF THE INVENTION

The present invention relates to a method of and a device for magnetic-abrasive machining of parts.

Magnetic-abrasive machining of parts is generally known in the art. It is usually that cylindrical parts are machined in the following way. A magnetic field is generated, a part is placed in the magnetic field and rotated about its axis and simultaneously oscillated along its axis, and a magnetic-abrasive powder is introduced into the area of machining simultaneously with cooling liquid which is poured into the area. In the device for the magnetic-abrasive machining, electromagnetic inductors are used, in which the magnetic flux is closed through a metal magnetic conductor and pole shoes as well as working gaps and the part to be machined. The external magnetic flux passes through the magnetic-abrasive powder and the metal part, magnetizes them, and therefore the part magnetically attracts the magnetic-abrasive powder. Simultaneously, a gradient of the magnetic field is produced which retains the magnetic-abrasive powder in the working gaps when the part is rotated and not rotated. The gaps are limited by the surface of the pole shoes. It is advisable to further improve the existing magnetic-abrasive machining methods and devices which provide accuracy of machining of the parts and at the same time to increase the material removal rate of machining.

Accuracy of cylindrical parts is characterized by out-of-roundness and deviation of shape of a longitudinal section. With the existing methods of the magnetic-abrasive machining the required out-of-roundness is provided, as disclosed for example in "Machining Time Estimation for Magnetic Abrasive Processes," G. Z. Kremen, et al., Int. J. Prod. Res., 1994, volume 32, number 12, pages 2817–2825. As for the shape of the longitudinal section of a part, it does not correspond to the requirements since the part obtains a barrel-like shape as a result of the machining. The formation of the barrel-like shape is caused by a non-uniformity of the magnetic field both at the pole shoes and in the longitudinal section of the cylindrical part. A gradient of magnetic field is formed along the perimeter of the pole shoes and at the ends of the part. A different value of the magnetic induction leads to a non-uniform pressing of the magnetic-abrasive powder against the part and correspondingly to a non-uniform material removal at the ends of the part.

Another disadvantage is a relatively low material removal rate which is lower than the material removal rate during conventional grinding. The reason for this disadvantage is that the conventional devices for magnetic-abrasive machining cannot generate a value of the magnetic induction more than 1.6 T. This disadvantage is even more substantial when a non-magnetic part composed for example of ceramics, glass, non-ferrous metals, etc. is machined, since the part does not form its own magnetic field and the magnetic-abrasive powder is not pressed against the part.

SUMMARY OF THE INVENTION

Accordingly, it is an object of the present invention to provide a method of and a device for magnetic-abrasive machining of parts, which avoids the disadvantages of the prior art.

In keeping with these objects and with others which will become apparent hereinafter, one feature of the present invention resides, briefly stated, in a method of magnetic-abrasive machining of a part, having a longitudinal axis, comprising the steps of generating an external magnetic field providing a magnetic flux, placing a part in the magnetic field, so that the magnetic flux extends perpendicular to the longitudinal axis of the part, supplying a magnetic-abrasive powder to the part in the magnetic field, rotating the part about the longitudinal axis and oscillating the part along the longitudinal axis, so that magnetic-abrasive powder is displaced by the rotating part in a circumferential direction, wherein the generating of the external magnetic field to provide a magnetic flux includes forming the external magnetic field by a coil which has two substantially coaxial coil portions which are connected with one another and arranged so that the part is located axially between the coil portions, and a fluid jet is supplied under pressure toward the magnetic-abrasive powder to press it against a surface of the part.

It is also an object of the present invention to provide a device for magnetic-abrasive machining of parts which has means for generating an external magnetic field providing a magnetic flux, means for rotating a part in the magnetic field, so that the magnetic flux extends perpendicular to a longitudinal axis of the part and at the same time oscillating the part along its longitudinal axis, means for supplying a magnetic-abrasive powder to the part in the magnetic field which magnetic-abrasive powder is displaced by the rotating part, and wherein the means for forming the external magnetic field for providing a magnetic flux includes a coil which is composed of coaxial coil portions connected with one another and arranged so that the part is located axially between the coil portions.

When the method is performed and the device is designed in accordance with the present invention, it eliminates the disadvantages of the prior art.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

BRIEF DESCRIPTION OF THE DRAWINGS

FIG. 1 is a view schematically showing a device for a magnetic-abrasive machining of a part in accordance with the present invention; and FIG. 2 is a view schematically showing movements of a magnetic-abrasive powder in the inventive method of machining.

DESCRIPTION OF THE PREFERRED EMBODIMENTS

A device for magnetic-abrasive machining in accordance with the present invention as shown in FIG. 1 includes means for generating a magnetic field formed as a electromagnetic coil 1 which is composed of two electromagnetic coil sections 2 and 3 connected with one another by connecting elements. The electromagnetic coil 1 generates a magnetic flux which is identified with reference numeral 4. The part to be machined is located in a gap between the coil sections 2 and 3. The part 5 is rotated about its longitudinal axis and oscillated in a direction of its longitudinal axis by well-known means. For example, the part 5 can be held in holders which are rotated by a drive and displaced in the longitudinal direction. A magnetic-abrasive powder 6 is introduced into the machining zones and retained by a magnetic gradient which will be explained in detail later on. During the rotation of the part 5 the magnetic-abrasive powder 6 is somewhat displaced in the circumferential direction by the part from the zones of the magnetic flux as shown in FIG. 1. When the part is non-ferromagnetic the magnetic gradient of the magnetic field retains the magnetic-abrasive powder on the surface of the part; however, there is no force which can actively press the magnetic abrasive powder against the part.

In accordance with the present invention, a fluid jet (a gas jet or a liquid jet) is supplied under pressure so as to be directed toward the magnetic-abrasive powder and to press the magnetic-abrasive powder against the part. The jet can be produced for example by nozzles 7. It is preferably directed radially towards the center of the part. In accordance with a preferred approach, the jet is directed toward the areas, to where the magnetic-abrasive powder is displaced by the rotating part from the zone of the magnetic flux as shown in FIG. 1. A maximum value of the pressure of the fluid jet is selected so as to maintain the effect which is characteristic only for the magnetic-abrasive machining. In particular, the grains of the magnetic abrasive powder must be retained from falling out from the machining zones by a magnetic gradient. They must be pressed against the part by the fluid jet directed to the center of the part and perform the movements which are similar to the reciprocal movements shown in FIG. 2 by the arrows. Also, the pressure of the fluid jet must be uniform along the whole area of the displaced magnetic-abrasive powder. This requirement is connected to the fact that the jet pressure must replace a magnetic force which presses the magnetic-abrasive powder when a magnetic part is performed and magnetic attraction force is directed toward the center of the part. The uniformity of pressure of the jet is necessary so that the powder is uniformly pressed against the surface to be machined in order to avoid the barrel-like shape.

Since the pressing force of the magnetic-abrasive powder against the part is increased, it is possible to increase the rotary speed of the part so as to increase the machining removal rate. The interaction of a high non-linear magnetic field gradient and the high uniform pressing force substantially increases the material removal rate.

It is to be understood that the method and device in accordance with the present invention can also be utilized when a part to be machined is ferromagnetic. In this case the force of pressing the magnetic abrasive powder against the part caused by magnetic attraction of the ferromagnetic part is further increased by the pressure applied by the fluid jet against the magnetic abrasive powder.

It will be understood that each of the elements described above, or two or more together, may also find a useful application in other types of constructions differing from the types described above.

While the invention has been illustrated and described as embodied in a method of and a device for magneto-abrasive machining of an part, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A method of magnetic-abrasive machining of a part having a longitudinal axis, comprising the steps of generating an external magnetic field providing a magnetic flux by an electromagnetic coil having substantially coaxial coil sections which are axially spaced from one another and connected with one another; placing the article in the magnetic field axially between the coil sections so that the magnetic flux extends perpendicular to the longitudinal axis of the part; rotating the part about the longitudinal axis and oscillating the part along the longitudinal axis; supplying a magnetic-abrasive powder into the machining zone onto the part in an area axially between the coil sections; and supplying a fluid jet under pressure toward the magnetic-abrasive powder so as to press the magnetic-abrasive powder against a surface of the part.

2. A method as defined in claim 1, wherein said supplying includes supplying the fluid jet to an area to which the magnetic-abrasive powder is displaced under the action of rotation of the part.

3. A method as defined in claim 1, wherein said supplying the fluid jet includes supplying the fluid jet in a direction toward a center of the part.

4. A device for magnetic-abrasive machining of a part having a longitudinal axis, comprising means for generating an external magnetic field providing a magnetic flux and including an electromagnetic coil having two substantially coaxial coil portions which are spaced from one another and spaced from one another; means for placing a part in the magnetic field axially between said coil sections so that the magnetic flux extends perpendicular to the longitudinal axis of the part; means for rotating the part about the longitudinal axis and oscillating the part along the longitudinal axis; means for supplying a magnetic-abrasive powder to the part in the magnetic field in a machining zone axially between said coil sections of said electromagnetic coil; means for supplying a fluid jet toward the magnetic-abrasive powder so as to press the magnetic-abrasive powder against a surface of the part.

5. A device as defined in claim 4, wherein said means for supplying the fluid jet is arranged so that the fluid jet supplied by said fluid jet supplying means is directed toward a region, to which the magnetic-abrasive powder is displaced under the action of rotation of the part.

6. A device as defined in claim 4, wherein said means for supplying a fluid jet is arranged so that the fluid jet supplied by said fluid jet supplying means is directed toward a center of the part.

* * * * *